US006871470B1

(12) United States Patent
Stover

(10) Patent No.: US 6,871,470 B1
(45) Date of Patent: Mar. 29, 2005

(54) METAL STUD BUILDING SYSTEM AND METHOD

(76) Inventor: Donie Stover, 6120 W. Cavalier, Glendale, AZ (US) 85301

( * ) Notice: Subject to any disclaimer, the term of this patent is extended or adjusted under 35 U.S.C. 154(b) by 141 days.

(21) Appl. No.: 10/053,450

(22) Filed: Jan. 17, 2002

(51) Int. Cl.[7] ..... E04H 12/00

(52) U.S. Cl. ..... 52/648.1; 52/243.1; 52/238.1; 52/241; 52/243; 52/632; 52/481.1; 52/731.9; 52/732.2; 52/731.3; 52/731.5; 403/109.1; 403/377

(58) Field of Search ..... 52/243.1, 238.1, 52/241, 243, 632, 481.1, 731.9, 732.2, 731.3, 731.5, 648.1; 403/109.1, 377

(56) References Cited

U.S. PATENT DOCUMENTS 2,241,722 A * 5/1941 Hurlbert, Jr. ..... 52/290
4,397,127 A 8/1983 Mieyal
5,040,345 A 8/1991 Gilmour
5,146,723 A 9/1992 Greenwood
5,471,805 A 12/1995 Becker
5,685,121 A 11/1997 DeFrancesco
5,755,066 A 5/1998 Becker

* cited by examiner

*Primary Examiner*—Carl D. Friedman
*Assistant Examiner*—Steve Varner
(74) *Attorney, Agent, or Firm*—LaValle D. Ptak

(57) ABSTRACT

A metal stud and clip assembly is designed for use in a non-load-bearing wall to allow a horizontal ceiling to vertically float thereon. This is accomplished by an elongated receiving channel on the stud spaced inwardly from its edges. A clip member has an elongated stabilizing bar slidably inserted into the channel, and the stabilizing bar itself then is secured to a horizontal ceiling or a track system mounted to the ceiling. Thus, relative movement of the ceiling with respect to the wall allows the stabilizing bar to move up and down in the receiving channel on the stud member.

7 Claims, 6 Drawing Sheets

METAL STUD BUILDING SYSTEM AND METHOD

BACKGROUND

Vertical metal studs are widely used in building construction, particularly in conjunction with commercial buildings, for the non-load-bearing interior walls. The studs generally are covered with drywall which is attached to them to form the interior walls of the structure in which they are used.

In the past, vertical metal studs in non-load-bearing interior walls of a building were connected directly between a track on the floor at their bottoms and a top track secured to the horizontal joists for floors or roofs of the building. Such construction has resulted in substantial problems, in that little if any vertical displacement of the floor or roof, at the top of the studs, could be tolerated.

The fixed relationship of the non-load-bearing studs and the floors or roofs connected to the top ends of the studs results in longitudinal compressive stresses on the studs, which frequently causes the studs to buckle laterally at intermediate locations, creating cracks or distortions in the walls of the building in which they are used. These longitudinal forces applied to the studs result from vertical displacement of the floor or roof of the building above the studs. The fixed relationship of the non-load-bearing studs, in the case of variations in load for office floors above the rooms in which the studs are used, or in the case of a heavy load of snow or the like on a roof, causes a significant downward pressure on the vertical non-bearing studs. If the studs are rigidly secured at both the top and bottom, between the floor of the room and its ceiling, unsightly and unacceptable cracks occur in the wall covering. In addition, the integral structure of the wall is weakened as a result of the buckling or partial buckling of the studs. When the load is lessened (in the case of an office building, by all of the workers leaving at the end of a day, or in the case of a roof, by the melting of snow), the cracks in the walls increase as the walls expand in response to the lessening vertical pressure on the studs. The studs themselves undergo a stretching or lengthening after their earlier buckling, which further contributes to the weakness of the wall.

Efforts to overcome the problems of a rigid interconnection between vertical studs in non-bearing walls and the ceilings or floors above them, by allowing relative movement of the ceiling or floor with respect to the studs, have been made. One effort is disclosed in the United States patent to Gilmour No. 5,040,345. This patent is directed to the addition of a stud clip to the head track for allowing vertical floating movement of a floor or roof structure above the stud to take place. The clip has a pair of opposing flanges, which are secured directly to the downwardly depending flanges of the head track. Another portion of the clip is inset slightly from the inner surface of the head track flanges. This inset portion includes grooves which accommodate the inwardly turned flanges on a standard stud. This allows the stud to slide up and down over the exterior of the clip between it and the flanges of the head track. The system is designed so that the length of the stud extends into or nestles within the downwardly turned flanges of the head track. If the clip were to be extended beyond these downwardly depending flanges, it would interfere with the attachment of drywall to the stud, since portions of the clip directly underlie the inwardly edges of the stud. There also is no provision in this patent for allowing sliding movement of drywall portions relative to one another; so that drywall necessarily would need to be spaced a sufficient distance below the downwardly turned edges of the head track to accommodate the expected vertical movement in the finished installation. This in turn allows sound to travel over the top of the drywall portions of the walls, from one room to another.

A different approach to the problem is disclosed in the DeFrancesco U.S. Pat. No. 5,685,121. As with the Gilmour patent mentioned above, the system of DeFrancesco also does not provide any provision for drywall overlap; so that sound can travel over the top of a wall built with this system. In DeFrancesco, a clip is designed for a slip fit within the open end of a stud. The clip includes an outwardly flared portion at the top, which then is secured to the flanges of the head track. The clip is designed to extend a substantial distance downwardly into the open end of the stud; and it includes elongated slots in its sides. The slots are designed to accommodate fasteners for drywall, which then may be passed through the studs and into the slots to permit the slip fit movement. The system, however, does not allow for drywall butt joints. Such joints will result in fasteners located on opposite sides of the slots; and if such a butt joint were to be secured in the area of the clip, the fasteners would secure the clip and the stud together in a non-movable relationship. This would defeat the purpose of the whole system. In addition, the system of DeFrancesco, as well as the system of Gilmour, preclude the running of any conduit through the wide or inside portion of the studs, since the clips of both of these patents completely overlie this portion. Consequently, no conduit could be run through the stud/clip assembly without securing the parts together. If conduit is run immediately below the clip, the relative vertical movement which is desired would be prevented, or severing of the conduit (and the wires within it) could result. As a consequence, the structures of both Gilmour and DeFrancesco clearly limit the location of any conduit running through the interior of the wall to a position substantially removed from the clip assembly itself.

The Becker U.S. Pat. Nos. 5,471,805 and 5,755,066 disclose a head track configuration with stepped surfaces to allow drywall overlap. This permits drywall attached to the header to slide over drywall attached to the studs which extend up into the header. This feature in the Becker patents provides a fire barrier connection, as well as a sound barrier. The disclosure of the Becker patents, however, does not show any guide whatsoever to hold the studs against tipping or shifting within the header. The studs are not held vertically within the header; and the only thing which holds the studs in their correct orientation is the connection of the drywall itself. The studs do not extend all the way to abut the header; so that limited vertical movement between the header and the top of the studs is permitted with this structure, allowing the overlapping drywall to slidably provide the necessary fire barrier. In the event of an earthquake, however, the studs are not held against lateral movement (particularly longitudinally of the header); so that the wall structure is subject to substantial damage in the event of an earthquake.

The Mieyal U.S. Pat. No. 4,397,127 discloses a stud extension with a slip fit onto the stud to then allow the stud to be interconnected with a suitable header. This extension allows a slip fit of the stud on the extension; but the extension itself has snap tabs on it to connect into the header. This requires additional manufacturing steps.

The Greenwood U.S. Pat. No. 5,146,723 is directed to an interior wall mounting device for providing a cosmetic interconnection between drywall sections which are vertically mounted on studs in the wall, and, in some cases, interconnections between drywall interfaces at both the ceiling and in corners of the room. The mounting devices are in the form of elongated parts which provide surfaces acting as crown molding, corner molding, or the like, in the finished construction. The structure disclosed in this patent, however, is not directed to slip fit interconnections between a head track and vertical studs to allow relative movements between the two.

Accordingly, it is an object of this invention to provide an improved stud and clip assembly which overcomes the disadvantages of the prior art, which effectively provides alignment for the studs while allowing relative movement between head track and the studs, and which allows a non-interfering location for the various components to allow standard connection of drywall and conduit passage at any location on the stud.

SUMMARY OF THE INVENTION

It is an object of this invention to provide an improved stud assembly system and method for permitting relative vertical movement between the ceiling or roof of a structure and the stud.

It is another object of this invention to provide an improved stud and clip assembly for use with metal studs to allow relative vertical movement between the roof or floor of the building in which the stud is located and the stud through slidable interconnections between elements of the clip and the stud which do not interfere with conventional construction utilization of the stud.

It is an additional object of this invention to provide an improved metal stud and clip assembly for metal studs used in non-load-bearing walls to secure the stud against lateral displacement while allowing relative vertical movement between the stud and the ceiling or floor to which the stud is attached.

It is a further object of this invention to provide an improved stud and stud clip assembly and method of installation for installing metal studs in a non-load-bearing wall to allow relative sliding movement between the clip and the stud to eliminate potentially damaging stresses from being applied to the stud.

In accordance with a preferred embodiment of the invention, a metal stud and clip assembly for use in a non-load-bearing wall is designed to allow a horizontal ceiling or floor to vertically float on the wall. The assembly includes an elongated metal stud member which has a generally U-shaped cross section including a main portion, and first and second edges having first and second side members attached thereto. At least a first receiver is attached to the main portion of the stud member; and it is spaced inwardly a predetermined distance from the first and second side members. A clip member has a first portion for attachment to a surface located above the stud; and it also has at least a first elongated stabilizing bar attached to it and extending downwardly to slidably engage the first receiver on the stud member. This allows relative vertical movement between the stud member and the stabilizing bar.

To install the stud and clip assembly in a non-load-bearing wall, the stabilizing bar of the clip member first is extended into the receiver on the stud to allow relative sliding movement between the bar and the receiver. The stud and the clip member then are positioned in the construction of a non-load-bearing wall; and the clip member is extended upwardly for attachment to a ceiling or floor above the stud.

DETAILED DESCRIPTION

Figure 1:
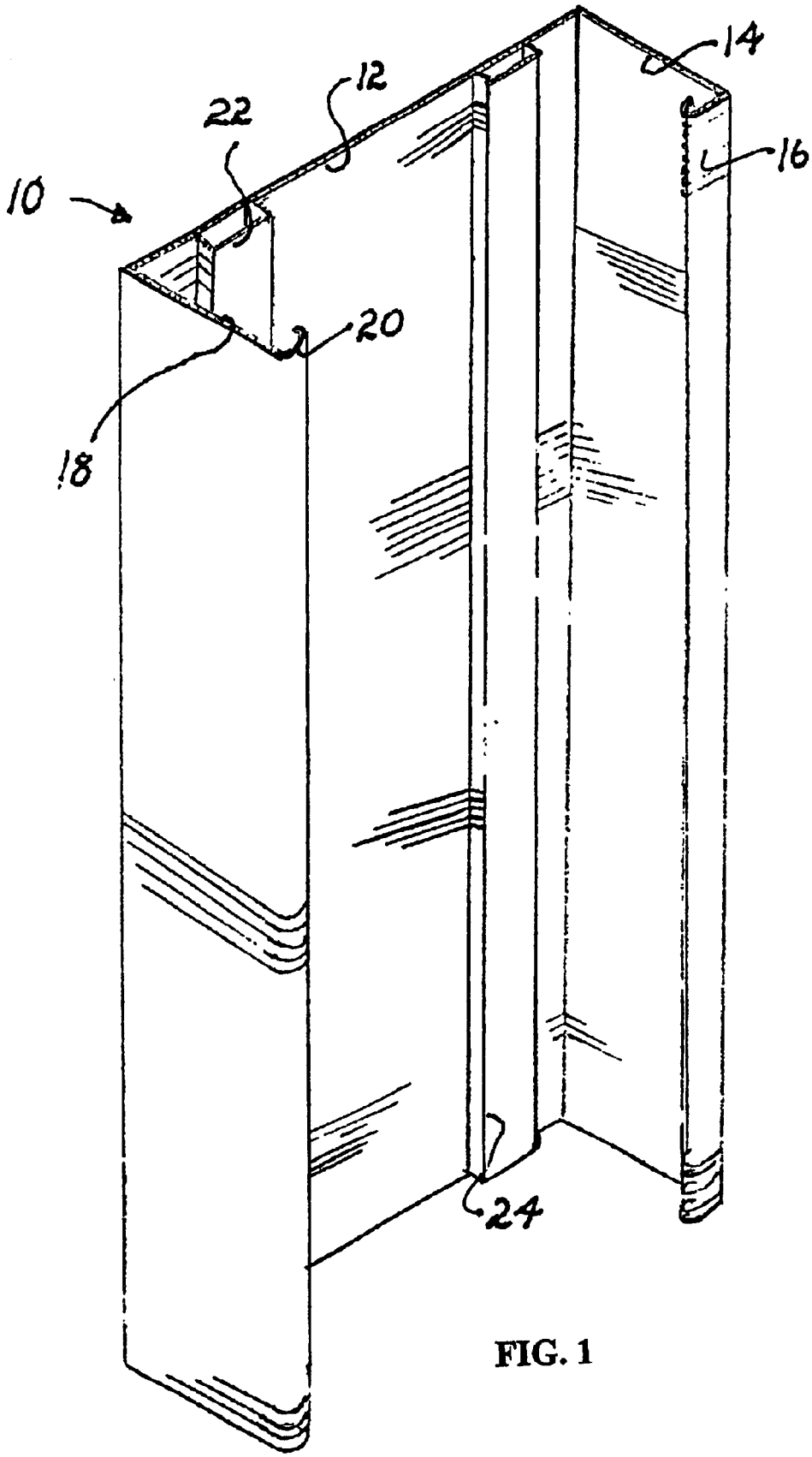
FIG. 1 is a front perspective view of a portion of a preferred embodiment of the invention.

Reference now should be made to the drawings, in which the same or similar components are designated by the same reference numbers throughout the different figures. FIG. 1 is a front perspective view of a metal stud made of galvanized steel, extruded aluminum or other suitable material, which incorporates the features of a preferred embodiment of the invention.

The stud 10 and has a generally U-shaped cross section. The bight of the cross section is a main member 12, typically located on the interior of a wall in which the stud 10 is used. The longitudinal edges of the member 12 have attached to them a pair of side members 14 and 18. The side members 14 and 18 may be integrally formed with the main member 12, or may be separately attached in accordance with known manufacturing techniques. As is typical with studs of this type, the free edges of the side members 14 and 18 are inwardly turned at 16 and 20, respectively. This portion of the metal stud which has been described is conventional; and the dimensional characteristics of the stud are identical to those of conventional studs not incorporating the invention.

The stud of FIG. 1, however, has been modified to include first and second receivers or receiver channels 22 and 24 attached to the main portion 12 and spaced inwardly from the side members 14 and 18, as is readily apparent from an examination of FIG. 1. The receivers 22 and 24 are in the form of hollow elongated rectangular cross-sectional channels, which extend parallel to the edges of the main portion 12, or parallel to the longitudinal dimension of the stud 10.

The hollow receiver channels 22 and 24 are spaced inwardly from the edges 14 and 18 a distance sufficient to permit the interconnection of standard drywall surfaces, corner beads and the like without interference. In addition, sufficient space is provided between the receiver channels 22 and 24 to allow the passage of conduit through the main member 12 in this space between the channels without interfering with the channels or the operation of those channels, as subsequently described.

Figure 2:
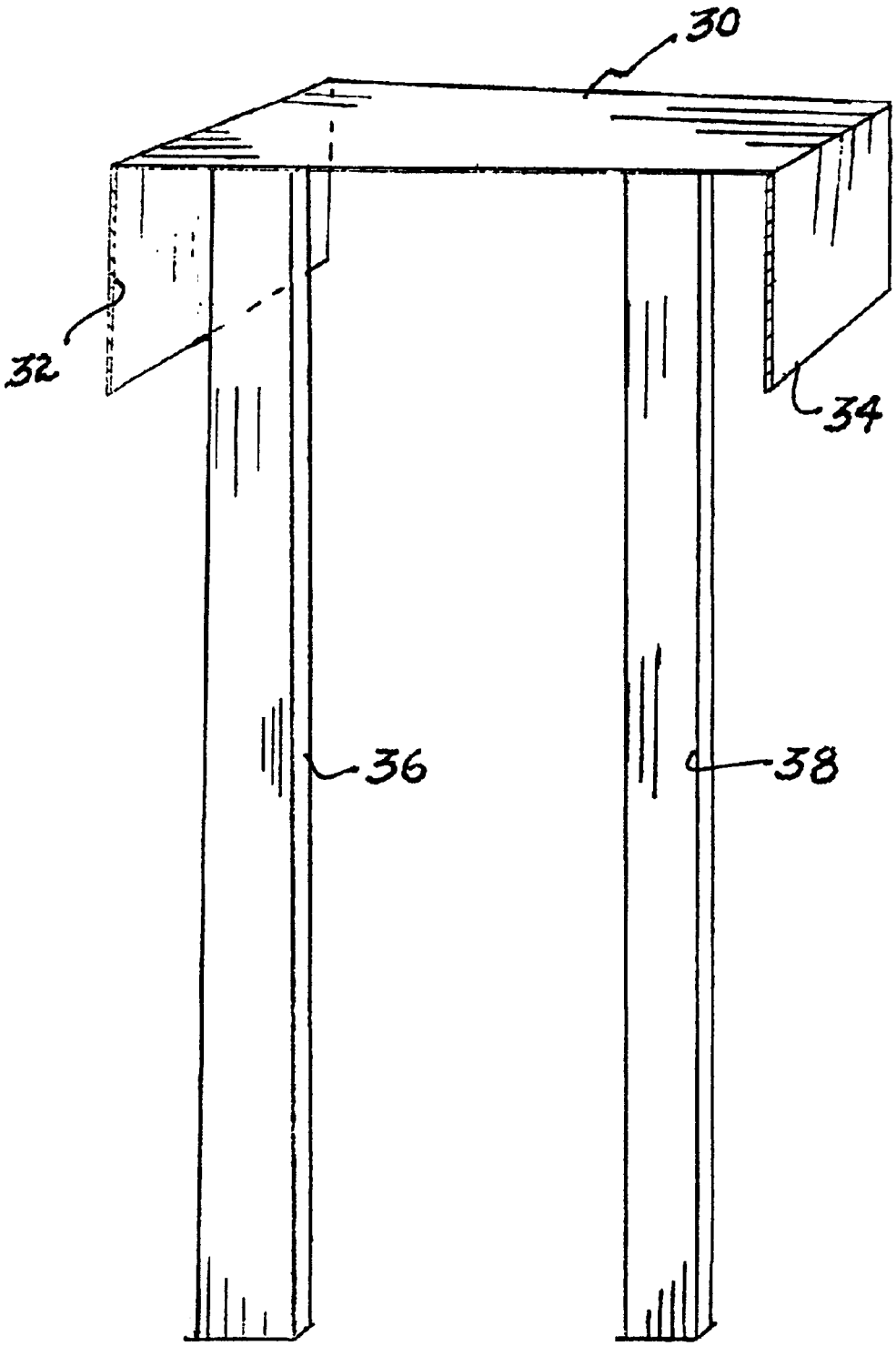
FIG. 2 is a front perspective view of another portion of a preferred embodiment of the invention.
Figure 3:
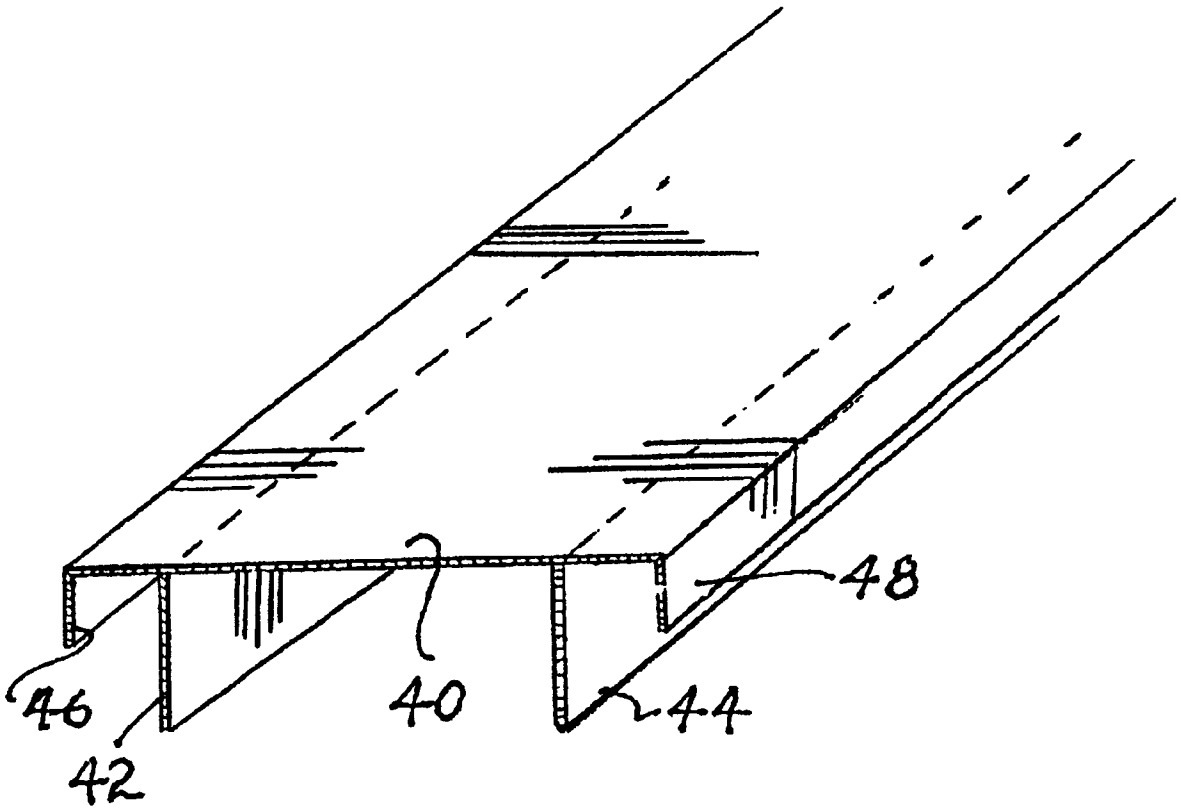
FIG. 3 is a top perspective view of an element used in conjunction with the preferred embodiment of the invention.

FIGS. 2 and 3 are perspective views of a slip clip assembly and a ceiling track assembly for utilization in conjunction with the stud of the invention shown in FIG. 1. In FIG. 3, a ceiling track of the type typically used in metal stud construction, to provide a guide or channel for the upper ends of the studs in non-load-bearing walls, is illustrated.

The track or guide channel of FIG. 3, however, has been modified to accommodate a feature of the invention described in greater detail subsequently.

The ceiling track comprises an elongated flat upper surface 40 designed to be attached to a ceiling or floor located above the wall in which the stud 10 of FIG. 1 is to be used. The channel of the track is formed by a pair of spaced apart downwardly depending flanges 42 and 44, which serve as guides for the stud assembly to be described. In addition, a second pair of downwardly depending flanges 46 and 48, shorter in length than the flanges 42 and 44, are provided along the edges of the portion 40.

FIG. 2 illustrates a slip fit clip assembly designed for use in conjunction with the ceiling track of FIG. 3 and the stud 10 of FIG. 1. The slip fit clip includes an upper portion 30 and two downwardly extending flanges 32 and 34. These flanges 32 and 34 are designed to fit inside the flanges 42 and 44, and are designed to be attached to the flanges 42 and 44 by means of suitable connectors. In the alternative, the surface 30 is designed to be attached by means of suitable fasteners to the channel 40. Prior to attachment of the clip assembly of FIG. 2 into the ceiling track 40 of FIG. 3, however, a pair of parallel elongated stabilizing bars 36 and 38, attached to the edge of the portion 30, and extending from it, are extended into the respective channels 24 and 22 of the stud shown in FIG. 1, and are slid downwardly into those channels. The outer dimensions of the stabilizing bars 36 and 38 are selected to snugly but slidably fit within the interior openings of the receiver channels 22 and 24.

Figure 4:
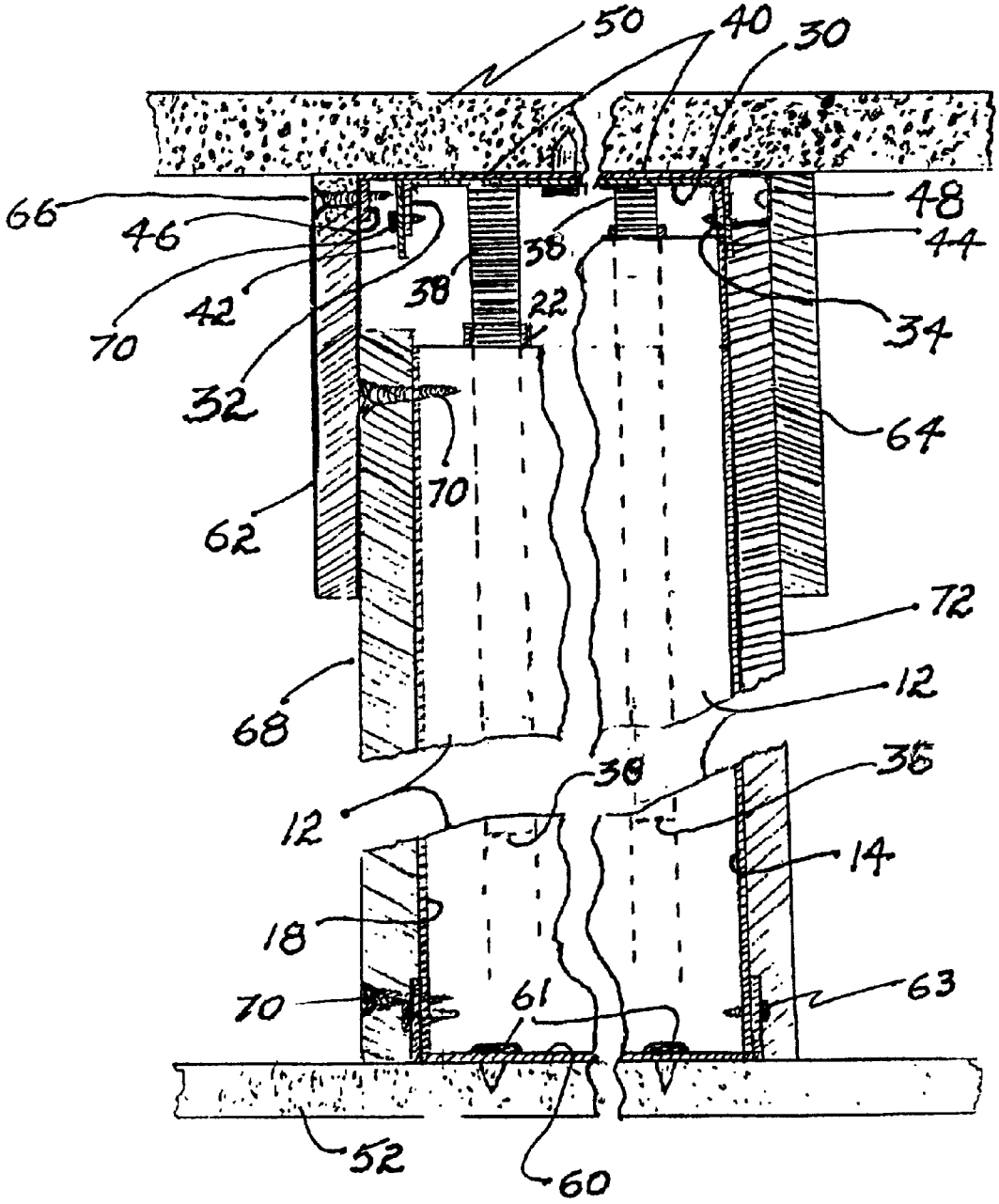
FIG. 4 is a partial cross-sectional side view of a wall structure employing a preferred embodiment of the invention.

Reference now should be made to FIG. 4, which illustrates a typical wall construction and which shows, on the left and right halves thereof, different relative vertical orientations of the various parts of a preferred embodiment of the invention installed into a typical wall. As shown in FIG. 4, a stud (one of many of which are used in a non-bearing interior wall) is shown as interconnected between an upper ceiling or floor 50 and a bottom floor 52. It should be noted that in the ensuing description, the word "ceiling" can mean any surface or member which is located above the non-bearing wall with which the invention is used and interconnected. It can be the horizontal joists of a roof truss, or it may simply be the lower side of a floor in a multi-story building.

In FIG. 4, a U-shaped channel 60 is secured to the floor by means of suitable fasteners 61 in the location of the wall which is to be constructed. The lower end of the stud 12/14/18 is attached to upturned flanges of the channel 60 by means of suitable fasteners 63, which extend through the upturned flanges of the channel 60 into the corresponding side members 14 and 18 of a typical stud used in the structure. Once this connection has been made, the clip 30/32/34, which has been pre-assembled with the stud with the stabilizer bars 36 and 38 inserted into the openings in the receiver channels 24 and 22, respectively, is moved upwardly to engage the lower surface of the guide channel 40, which has been secured to the ceiling 50 by any suitable manner. It should be noted that the upper end of the stud 12/14/18 is located below the lower edges of the downwardly extending flanges 42 and 44 (as viewed in the left-hand portion of FIG. 4) to accommodate relative vertical movement between the floor 50 and the top of the stud.

When the location of the elements is such that the stud is properly vertically oriented, the clip 30 is slid upwardly into place to engage the lower surface of the channel 40 and the parts are secured together by means of suitable fasteners, as described previously. This allows the stabilizer bars 36 and 38 to extend downwardly into the top open ends of the respective channels 24 and 22, as illustrated in FIG. 4.

Initially, the relative spacing shown on the left-hand side of the broken line in FIG. 4 shows the orientation of the various parts of the assembly. A suitable surface, such as drywall 68, is applied to the left-hand side of the stud to form the surface of the wall defined by a row of studs, such as the stud shown in FIG. 4. As shown, the drywall 68 is attached by means of suitable fasteners 70; and it is readily apparent that the fasteners 70 completely clear the receiver channels 22 and 24 without any interference. Similarly, drywall 72 is attached to the right-hand side. To provide for a suitable sound and fire barrier, additional strips of drywall, such as the drywall strips 62 and 64 shown on opposite sides of the stud are attached to the flanges 46 and 48 by means of suitable fasteners, such as the fasteners 66 shown in the left-hand portion of FIG. 4. These drywall strips slidably overlap the corresponding drywall sheets 68 and 72, as illustrated in FIG. 4, to permit relative vertical movement between the sheets 62 and 68 and the sheets 64 and 72. It should be noted that the spacing between the flanges 42/46 and the flanges 44/48 is selected to permit a snug overlapping relationship between the drywall segments 62/68 and 64/72.

Reference now should be made to the right-hand side of FIG. 4, which essentially shows a split of a stud and all of the other structure vertically to illustrate the relative orientation of the parts when the ceiling 50 sags downwardly toward the top edge of the stud 12/14/18. As shown in the right-hand portion of FIG. 4, the space between the top of the stud and the inside of the clip 30 is substantially less than the space shown in the left-hand portion of FIG. 4, which illustrates the normal or installed relative spacing of the components. It should be noted in conjunction with FIG. 4 that the utilization of the split drawing configuration is done for the purpose of conserving drawing space, and that both sides of a stud simultaneously incur either the spacing shown in the left-hand side of FIG. 4, or that shown in the right-hand side of FIG. 4 as the ceiling 50 moves downwardly and back up again, as the load on it varies.

Figure 5:
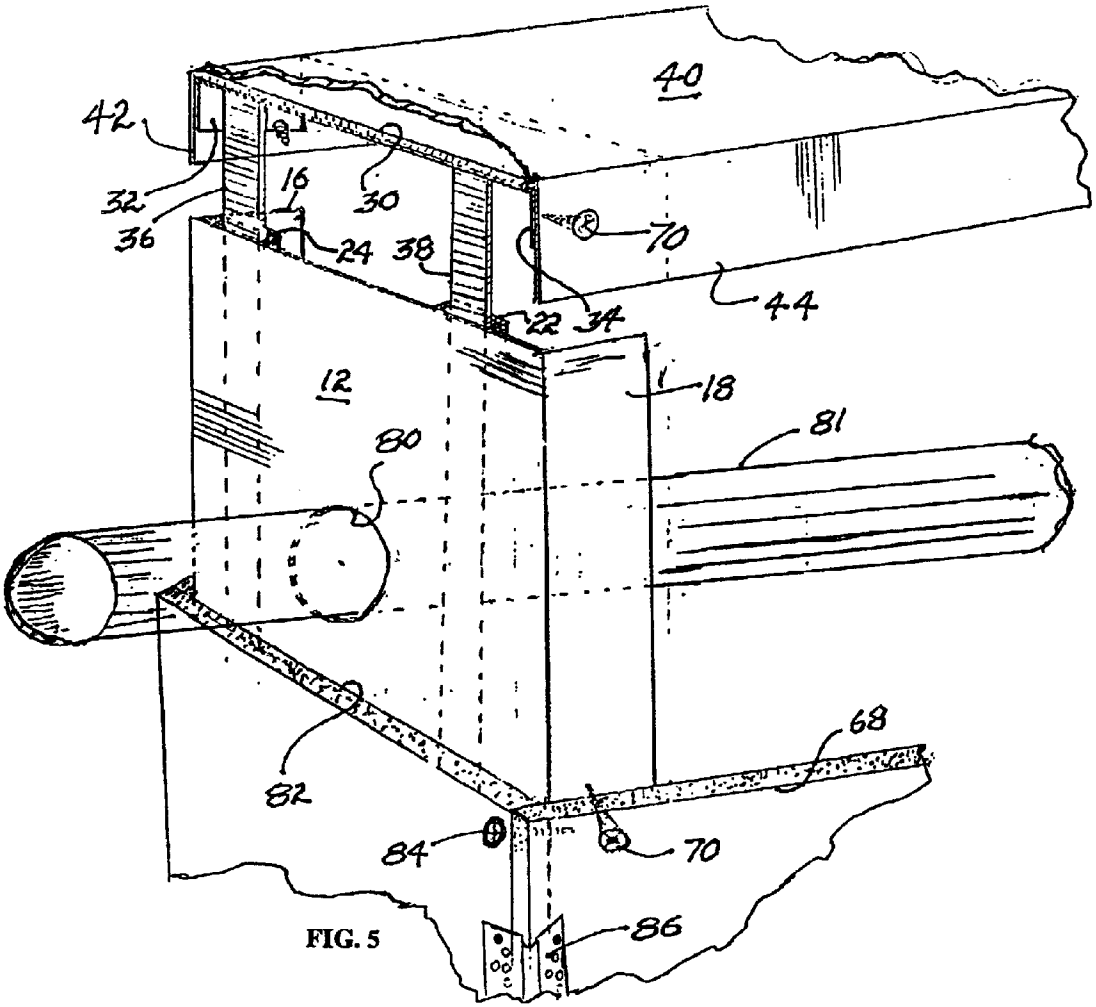
FIG. 5 is a partial front perspective view of a structure of a preferred embodiment of the invention illustrating details thereof.

FIG. 5 is a partially cut away perspective view of a completed assembly in accordance with a preferred embodiment of the invention. In the embodiment shown in FIG. 5, the ceiling track 40 is illustrated as having only the two flanges 42 and 44 secured to it. This configuration may be used any time the overlapping drywall feature described above in conjunction with FIG. 4 is not desired. The remainder of the assembly shown in FIG. 5, however, is identical to that described previously in conjunction with FIGS. 1 through 4, and operates in the same manner as the embodiments illustrated in FIGS. 1 through 4. The stud, ceiling track and clip assembly are the same as described previously; and the orientation and operation of the various parts is as previously described.

FIG. 5, however, further illustrates the manner in which the receiver channels 22 and 24, along with the stabilizer bars 38 and 36, are located to preclude interference from the interconnection of drywall sheets such as the sheets 68 and 82 to either the sides or ends (the flat surface or main portion 12 of the stud 10), as illustrated. Typically, when drywall sheets are attached, the fasteners 70 and 84 at the edges are located in the areas illustrated. It is readily apparent that whether a sheet 82 is applied to the main or flat portion 12 of the stud 10, or whether a sheet 68 is attached to the edge or side member, such as the member 18, the fasteners are completely free of any interference with the receiver channels 22 and 24, and therefore, with the slidably inserted stabilizing bars 38 and 36. This also is true of corner beading, such as the beading 86 which is typically applied over joints at a corner of the type illustrated in FIG. 5. Any fasteners which are used to secure the corner bead 86 over the ends of the drywall sheets 68 and 82 completely clear the receiver channels 22 and 24.

Finally, it should be noted that, as illustrated in FIG. 5, conventional conduit 81 may be passed through circular openings 80 formed in the main portion 12 of the studs between the receiver channels 22 and 24 without interfering in any way with the relative vertical sliding movement between the stabilizing bars 36 and 38 and the receiver channels 24 and 22. As a consequence, the structure of the preferred embodiment of the invention allows conventional construction techniques to be utilized with respect to other standard elements of wall and conduit structure without regard to the location of the clip receiver channels or stabilizing bars.

Figures 6, 7:
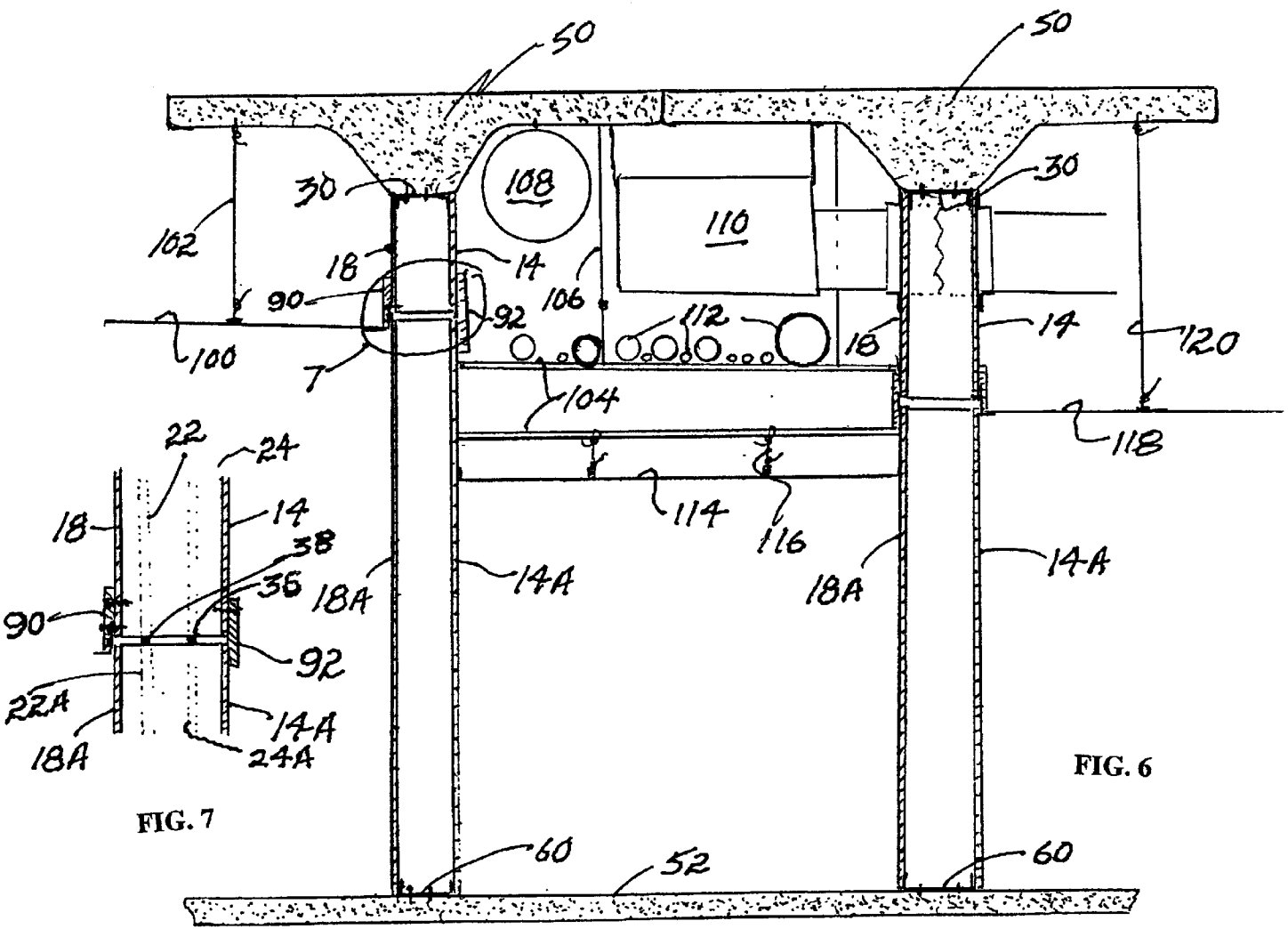
FIG. 6 is a cross-sectional configuration of an alternative use of a preferred embodiment of the invention, illustrating other features of the invention.
FIG. 7 is an enlarged detail of the circle portion designated as "7" in FIG. 6.

FIG. 6 illustrates a general structural configuration of the type which may be used in conjunction with the wall and ceiling structure described in conjunction with FIGS. 1 though 5. In addition, FIG. 6 illustrates an alternative to the use of the clip and receiver channel configuration of the studs for providing extensions of studs for particular structural installations. In the embodiment shown in FIG. 6, two interior walls including a pair of studs or stud assemblies are shown in an end view of those walls, taken in cross section at some point between the studs. The structure shown includes a room with a suspended interior ceiling 100 on the left-hand side of the structure, a suspended ceiling 114 in a hallway or room between the two walls formed by the studs, and a suspended ceiling 118 in a room on the right-hand side of the structure shown in FIG. 6. The ceiling heights of all of these suspended ceilings, as measured from the floor 52, are different.

The studs of the walls in the embodiment shown in FIG. 6 are attached through channels 60 to the floor 52 in the manner described previously in conjunction with FIG. 4. At the top, a mounting clip 30 is illustrated as secured directly to the structural ceiling 50. It is obvious from an examination of FIG. 6, that the structural ceiling 50 is located a substantial distance above the suspended ceilings 100/114/118, described previously. The structure may be the same as described in conjunction with FIG. 4; or it may include stud extensions still utilizing the unique features of the clip and stabilizing bars 36 and 38 shown in FIG. 2.

To utilize the system as a stud extender, short lengths of studs, such as shown by means of the upper side members 14 and 18 on both of the left-hand and right-hand wall configurations, may be secured directly to the flanges 32 and 34 of the clip 30 at their upper ends. The stabilizer bars 36 and 38 extend downwardly through the respective receiver channels 24 and 22 in the manner described previously, and extend all of the way through the length of the upper segments of studs shown in FIG. 6. Longer studs, illustrated by the side members 14A and 18A in both the left-hand and right-hand interior walls of FIG. 6, then are located in longitudinal alignment with the upper segments; and the stabilizer bars 36 and 38 extend from the upper stud segments through a space provided between the upper and lower segments into the corresponding channels 22A and 24A of the lower stud segments, as illustrated in FIG. 7.

The gap between each of the upper stud segment and the lower primary studs is selected to be sufficient to allow for relative vertical movement between the ceiling 50 and the floor 52, in the manner described previously. Fire and sound barriers may be provided by elongated strips of drywall 90 and 92 attached to only the upper stud side members 18 and 14, respectively, as illustrated in FIG. 7, and slidably engaging the upper edges or surfaces of the side members 14A and 18A of the lower or main studs.

As illustrated, the suspended ceiling 100 is suspended from the primary structural ceiling 50 by means of hangers 102; and the ceiling 118 is suspended by means of hangers 120. In the narrow or hallway section of the structure shown in FIG. 6, there typically are located a variety of conduits, pipes, heating/cooling chases, and the like. These are illustrated as conduit and water pipes 112, which are located on an interior frame 104, suspended from the ceiling 50 by means of hangers 106. This area also may include larger duct work 110 and air conditioning or other conventional duct work 110, which may extend perpendicularly into the plane of the drawing sheet of FIG. 6, or laterally out into the space between the suspended ceiling 118 and the structural ceiling 50. In any event, relative movement of the ceiling 50 and the various suspended ceilings 100/104/114 and 118, with respect to the floor, takes place by decreasing and increasing the open space between the stud segments illustrated in detail in FIG. 7, to allow this movement without placing any stress on the shortened stud segments or the elongated segments shown in FIG. 6. Consequently, the stud and clip assembly of FIGS. 1 and 2 is highly versatile for a variety of different installation purposes, as described above in conjunction with all of the various figures.

The foregoing description of the preferred embodiment of the invention is to be considered illustrative and not as limiting. Various materials may be used to form the different parts of the invention; and the manner of forming and fabricating these different parts and/or materials together may be varied by those skilled in the art, without departing from the true scope of the invention. Various other changes and modifications will occur to those skilled in the art for performing substantially the same function, in substantially the same way, to achieve substantially the same result without departing from the true scope of the invention as defined in the appended claims.

What is claimed is:

1. A metal stud and clip assembly for use in a non-load-bearing wall to allow a horizontal ceiling or floor to vertically float thereon, the assembly including in combination:

an elongated metal stud member having a generally U-shaped cross section including a main portion with first and second edges and having first and second side members attached, respectively, to the first and second edges of the main portion;

first and second receivers attached to the main portion of the stud member and each spaced inwardly a predetermined distance from the first and second side members; and a clip member having a first portion for attachment to a surface located above the stud and having first and second elongated stabilizing bars attached thereto and extending downwardly to slidably engage the first and second receivers, respectively, on the stud member to allow relative vertical movement between the stud member and the stabilizing bar.

2. The assembly according to claim 1 wherein the first and second receivers are hollow, elongated parallel channels spaced inwardly from the first and second side edges of the main portion of the stud member and extending the length thereof.

3. The assembly according to claim 2 wherein the stud member and the elongated channels are extruded from metal.

4. The assembly according to claim 3 wherein the clip member has first and second parallel elongated stabilizing bars attached thereto extending downwardly from the main portion thereof.

5. A metal stud and clip assembly for use in a non-load-bearing wall to allow a horizontal ceiling or floor to vertically float thereon, the assembly including in combination:

an elongated metal stud member having a generally U-shaped cross section including a main portion with first and second edges and having first and second side members attached, respectively, to the first and second edges of the main portion;

at least a first receiver attached to the main portion of the stud member and spaced inwardly a predetermined distance from the first and second side members, the first receiver comprising an elongated hollow channel extending parallel to the first and second edges of the main portion of the stud member; and a clip member having a first portion for attachment to a surface located above the stud and having at least a first elongated stabilizing bar attached thereto and extending downwardly to slidably fit into the elongated channel on the stud member to allow relative vertical movement between the stud member and the stabilizing bar.

6. The assembly according to claim 5 further including a second elongated hollow channel on the main portion of the stud member spaced from the first elongated channel and extending parallel thereto, and a second elongated stabilizing bar attached to the clip member dimensioned to slidably fit into the second elongated channel on the stud member.

7. The assembly according to claim 5 wherein the clip member comprises a generally U-shaped member having a flat main portion with downwardly turned ends for fitting into a mating track mounted above the location of the stud member, and wherein the stabilizing bar extends substantially perpendicularly downwardly from the main portion of the clip member.

* * * * *